United States Patent [19]

Matsumoto

[11] 4,129,109

[45] Dec. 12, 1978

[54] VARIABLE DISPLACEMENT INTERNAL COMBUSTION ENGINE WITH MEANS FOR SWITCHING DEACTIVATED CYLINDER GROUPS AT APPROPRIATE TIMING

[75] Inventor: Junichiro Matsumoto, Yokosuka, Japan

[73] Assignee: Nissan Motor Company, Limited, Yokohama, Japan

[21] Appl. No.: 823,746

[22] Filed: Aug. 11, 1977

[30] Foreign Application Priority Data

Aug. 12, 1976 [JP] Japan ..... 51-95383

[51] Int. Cl.[2] ..... F02B 3/00; F02D 13/06

[52] U.S. Cl. ..... 123/198 F; 123/32 EA; 123/32 EH; 123/32 EL

[58] Field of Search ..... 123/198 F, 32 EA, 32 EH, 123/32 EL, 32 EC

[56] References Cited

U.S. PATENT DOCUMENTS

| | | | |
|---|---|---|---|
| 2,875,742 | 3/1959 | Dolza | 123/198 F X |
| 3,756,205 | 9/1973 | Frost | 123/198 F X |
| 3,896,779 | 7/1975 | Omori et al. | 123/32 EA X |
| 4,015,428 | 4/1977 | Kawai | 123/198 F X |
| 4,023,358 | 5/1977 | Maurer et al. | 123/198 F X |

*Primary Examiner*—Ira S. Lazarus

*Attorney, Agent, or Firm*—Bacon & Thomas

[57] ABSTRACT

In a variable displacement internal combustion engine, a pair of cylinder groups are alternately switched into deactivation for fuel economy when reduced power output can operate the vehicle adequately at an appropriate timing detected when engine output power is at maximum or minimum so that harmful effect on engine performance is minimized during switching periods.

10 Claims, 4 Drawing Figures

FROM MODE SEL. 13
14
15
16
17
LOGIC GATE CIRCUIT
19
Vcc
24
23
22
J Q
C
K
J Q
C
K Q̄
INJ
PLS
59
51
MM
Vcc
R
56
53
55
C
54
MM
Vcc
57
58
60
52
50

VARIABLE DISPLACEMENT INTERNAL COMBUSTION ENGINE WITH MEANS FOR SWITCHING DEACTIVATED CYLINDER GROUPS AT APPROPRIATE TIMING

BACKGROUND OF THE INVENTION

The present invention relates generally to multicylinder internal combustion engines of a variable displacement type in which a number of cylinders is deactivated in response to sensed engine load, and specificially it relates to an electronic fuel injection of the variable displacement type in which the deactivated cylinders are switched from one group to another when the engine is at maximum or minimum load.

Variable displacement internal combustion engines are known in the art to improve fuel economy by selectively shutting off fuel supply to several cylinders of the engine when reduced power output can operate the vehicle adequately. However, if deactivation takes place for an extended period of time, the deactivated cylinders will be cooled and thus there is hesitation in firing when the cylinders are reactivated by power demand. This problem is particularly serious if deactivation is incorporated in an electronic fuel injection since the deactivation can be effected simply by electrically cutting off the supply of injection pulses without providing additional components that permit the intake valves of the cylinders to close during deactivation. Therefore, air flow is sucked into the deactivated cylinders in each cylinder cycle as well as into the activated cylinders so that the deactivated cylinder is severely cooled as compared to the activated cylinders.

This hesitation problem can be alleviated by allowing the deactivation process to take place in a specified group of cylinders for a prefixed period of time and then switching the deactivation to occur in another group of cylinders for another prefixed period of time and repeating this process at intervals. However, the switching action occurs at predetermined intervals regardless of the varying engine loads, a mechanical shock can occur if switching takes place when the engine is at nearly full load.

SUMMARY OF THE INVENTION

The present invention is an improved variable displacement internal combustion engine which results from the discovery that when the engine is at full load there is no deactivation so that switching can take place in advance of a subsequent deactivation process without causing mechanical shock and that when the engine is at minimum load switching of the deactivated cylinders from one group to another produces substantially no harmful effect because of the minimum output power demand.

According to the invention, first and second throttle position sensors are provided, one for detecting when the throttle valve is nearly wide open and the other for detecting when the throttle is nearly closed. When the engine is at maximum load a first signal results from the first sensor to provide switching in advance of the subsequent deactivation process. When the engine is at minimum load, a second signal results from the second sensor to switch the deactivation from one group of cylinders to another.

According to a further feature of the invention, there is provided a timing circuit which is responsive to the detection of maximum or minimum load condition to provide a timing action to generate a switching signal after the elapse of a predetermined period of time. The switching signal is then fed back to the timing circuit to reset the same to provide the next timing action so that the switching can take place at intervals if minimum engine load exists for an extended period of time on highway vehicle operations. The switching signal is disabled when the engine load suddenly changes to full output power.

An object of the invention is therefore to minimize the harmful effect resulting from the switching of deactivated cylinders by appropriate timing operation in response to maximum or minimum engine output power. The present invention can be understood from the following detailed description taken in conjunction with the accompanying drawings.

DESCRIPTION OF THE PREFERRED EMBODIMENTS

Figure 1:
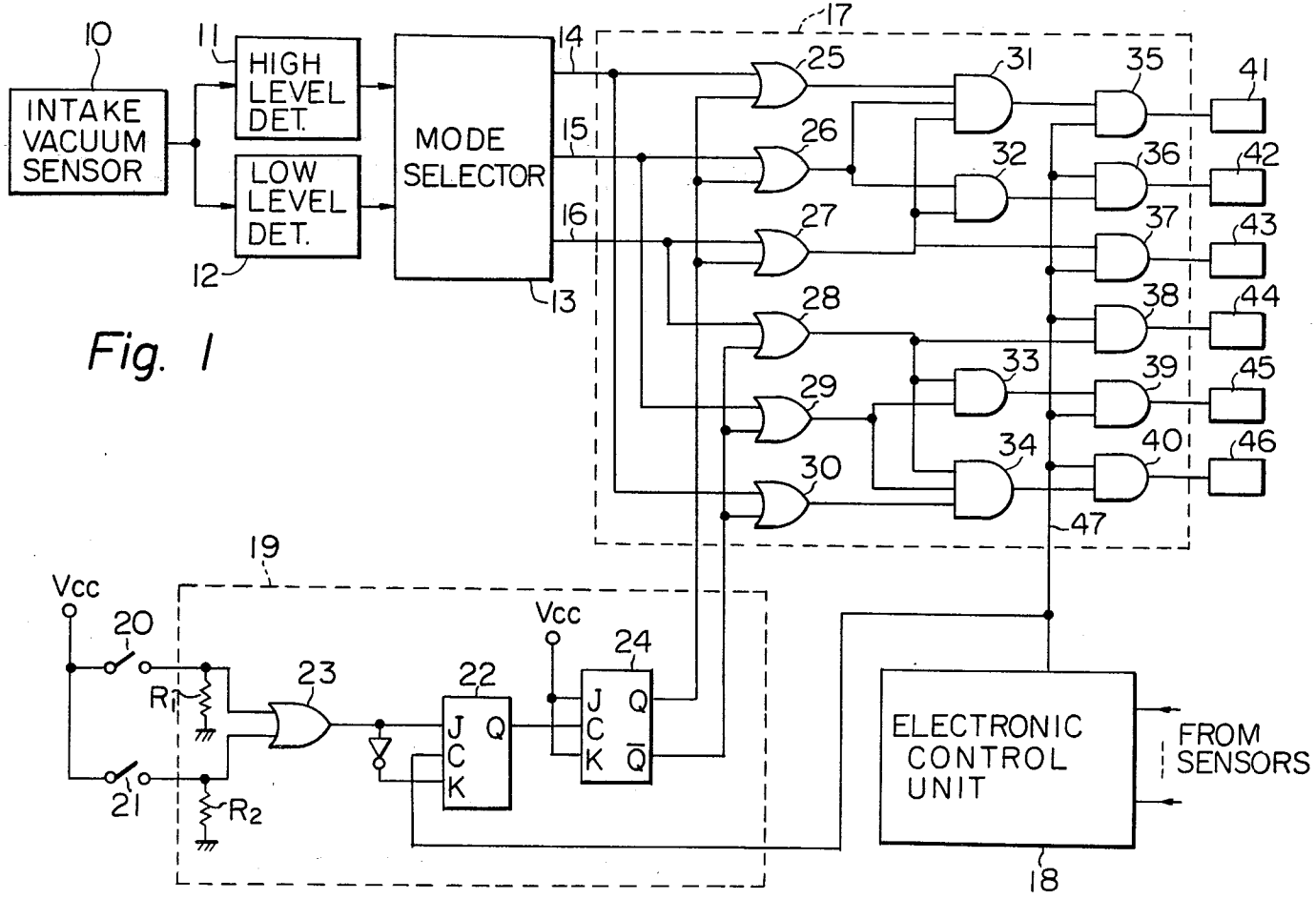
FIG. 1 is a circuit block diagram of a first preferred embodiment of the invention.

Referring now to FIG. 1, an intake vacuum sensor 10 is provided to detect the manifold vacuum and converts the sensed vacuum into a corresponding electrical signal which is fed into high and low level detectors 11 and 12. The high level detector 11 provides an output when manifold vacuum rises above a first predetermined value and the low level detector provides an output when the vacuum drops below a second predetermined value smaller than the first predetermined value. The signals from the high and low level detectors are fed into a mode selector circuit 13 which determines the number of injectors to be inactivated and provides a low-level voltage output or a logic "0" on leads 14, 15 and 16 which respectively indicates 5-, 4- and 3-cylinder modes and if no output is delivered from the leads 14 to 16 the engine is operated in 6-cylinder mode. The outputs from the mode selector 13 are fed into a logic gate 17 which distributes injection pulses supplied from an electronic control unit 18 to desired injectors under the control of a group switching circuit 19.

A throttle position sensor or switch 20 detects when the throttle valve is nearly wide open and closes its contacts to develop a voltage across resistor R1 which is fed into the J input of a flip-flop 22 through OR gate 23. Another throttle position sensor or switch 21 detects when the throttle valve is nearly closed to develop a voltage across resistor R2 which is coupled to the J input of flip-flop 22 via OR gate 23. This flip-flop is clocked by the injection pulse from the control unit 18 so that it changes its binary state in response to the leading edge of an injection pulse subsequent to the closure of switch 20 or 21. The output of flip-flop 22 is connected to the clock input of a J-K flip-flop 24 which changes its state in response to the leading edge of each input on the clock terminal.

The logic gate circuit 17 comprises OR gates 25 through 30, AND gates 31 to 34 and AND gates 35 through 40. The OR gates 25 to 30 are divided into a first group of OR gates 25 to 27 and a second group of OR gates 28 to 30, with the first group being associated with a first group of injectors 41, 42 and 43 and the second group being associated with a second group of injectors 44, 45 and 46. The OR gates in the first group have one of their inputs connected together to the Q output of flip-flop 24, OR gates in the second group having one of their inputs connected together to the complementary or $\overline{Q}$ output of flip-flop 24. OR gates 25 to 27 provide a low-level voltage output in response to a "0" output on leads 14 to 16, respectively, when the Q output of flip-flop 24 remains in the "0" state. Likewise, OR gates 28 to 30 provide a "0" output in response to a "0" output on leads 14 to 16, respectively, when the complementary output of flip-flop 24 remains in the "0" logic state. Therefore, a "0" output from OR gate 25 will disable AND gate 31 and hence AND gate 35 so that injector 41 of the first group is inactivated. Likewise, a "0" output from OR gate 26 will disable AND gates 31 and 32 so that injectors 41 and 42 are deactivated.

Figure 2:
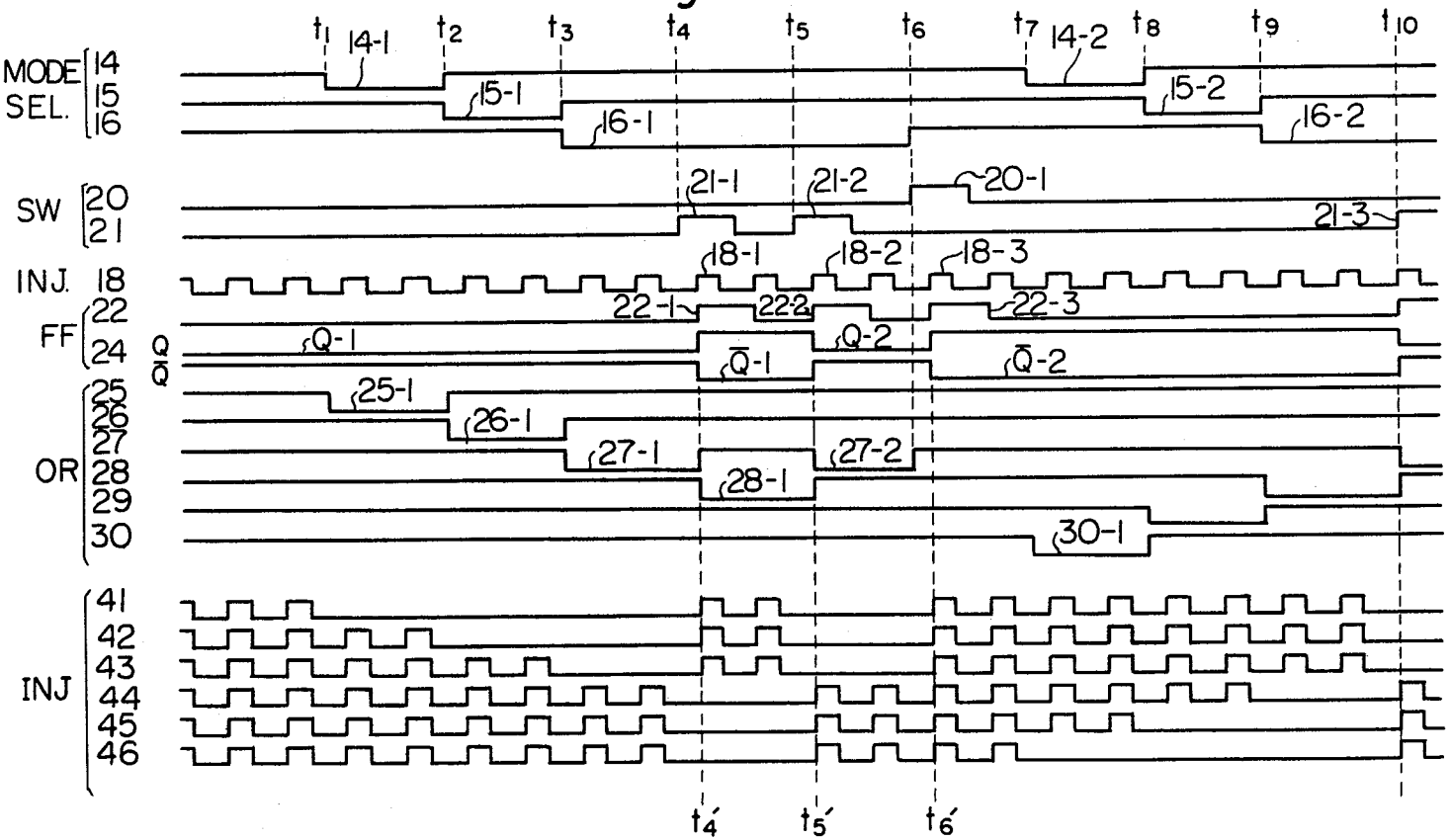
FIG. 2 is a timing diagram useful for describing the operation of FIG. 1.

The injection pulse is generated from the electronic control unit 18 which is adapted to process various engine parameters to determine the optimum duration of the pulse for each cylinder cycle and fed into AND gates 35 to 40 on lead 47. The operation of the embodiment of FIG. 1 will best be understood by reference to the diagram shown in FIG. 2.

It is assumed that up until time $t_1$ all of the injectors 41 to 46 are activated and a "0" output 14-1 on lead 14 from mode selector 13 is generated during interval $t_1$ to $t_2$ which represents a 1-cylinder deactivation period to operate the engine in 5-cylinder mode. OR gate 25 provides a "0" output 25-1 if flip-flop 24 is assumed to be in a state where its Q output remains at low voltage level providing a "0" output Q-1, so that injector 41 is disabled during the interval $t_1$ to $t_2$ two cylinder cycles for purposes of clarity. If the manifold vacuum is still above the higher reference level, another deactivation signal 15-1 is generated from lead 15 at time $t_2$ and OR gate 26 provides an output 26-1 to AND gates 31 and 32 so that injectors 41 and 42 are simultaneously inactivated. The same process will take place if the vacuum is still higher than the reference generating another deactivation signal 16-1 from lead 16 at time $t_3$ which provides a signal 27-1 from OR gate 27 and simultaneously disables AND gates 35, 36 and 37. Injectors 41, 42 and 43 are thus deactivated.

If it is assumed that throttle is nearly closed at time $t_4$, throttle position sensor 21 is activated providing an output 21-1 which is coupled through OR gate 23 to the J-K flip-flop 22 causing it to provide a "1" output 22-1 in response to the leading edge of an injection pulse 18-1 subsequent to time $t_4$. Flip-flop 24 is thus caused to change its state to generate a $\overline{Q}$-1 output and as a result OR gate 28 of the second group provides an output 28-1 which disables AND gates 38, 39 and 40 so that all of the injectors of the second group are deactivated. Therefore, the deactivated injectors are switched from injectors 41 to 43 to injectors 44 to 46 at time $t_4'$. This condition exists until time $t_5$ at which the next output 21-2 is assumed to be generated from throttle position sensor 21. In response to an injection pulse 18-2 subsequent to time $t_5$, flip-flop 22 generates an output 22-2 which causes flip-flop 24 to generate an output Q-2 so that OR gate 27 is supplied with "0" inputs to provide an output 27-2 which deactivates injectors 41 to 43 instead of injectors 44 to 46 at time $t_5'$.

Wide open throttle operation takes place at time $t_6$ which is sensed by throttle position sensor 20 generating a signal 20-1. The manifold vacuum drops below the lower threshold level so that detector 12 provides an output to the mode selector 13. The mode selector places a "1" output on each of its output leads 14 to 16 to permit all the injectors to be activated. Subsequent to time $t_6$, flip-flop 22 is triggered by injection pulse 18-3 to provide an output 22-3 which causes flip-flop 24 to provide a Q-2 output, which switches the deactivation injector group from the first to second group in advance of subsequent deactivation process which will commence at time $t_7$.

At time $t_7$ manifold vacuum is assumed to have risen above the higher threshold level so that mode selector 13 responds to it by generating a "0" output 14-2 on lead 14. Since the $\overline{Q}$ output of flip-flop 24 is low, OR gate 30 produces a "0" output 30-1 which disables AND gates 34 and 40 so that injector 46 is deactivated. The same deactivation process will repeat to increase the number of deactivated injectors one for each of the output signals 15-2 and 16-2 from mode selector 13 until time $t_{10}$ when a third throttle-closed signal 21-3 is generated. The signal 21-3 changes the output states of flip-flop 24 so that the deactivated group is switched from the second to the first group.

It is understood that the switching action in response to a nearly wide-open throttling operation takes place when all the injectors are being activated prior to a subsequent deaction process, no mechanical shock arises during the switching period. The switching action during the closed throttling operation also produces no adverse effects on the engine performance since the engine output at the instant of switching is at a minimum.

Figure 3:
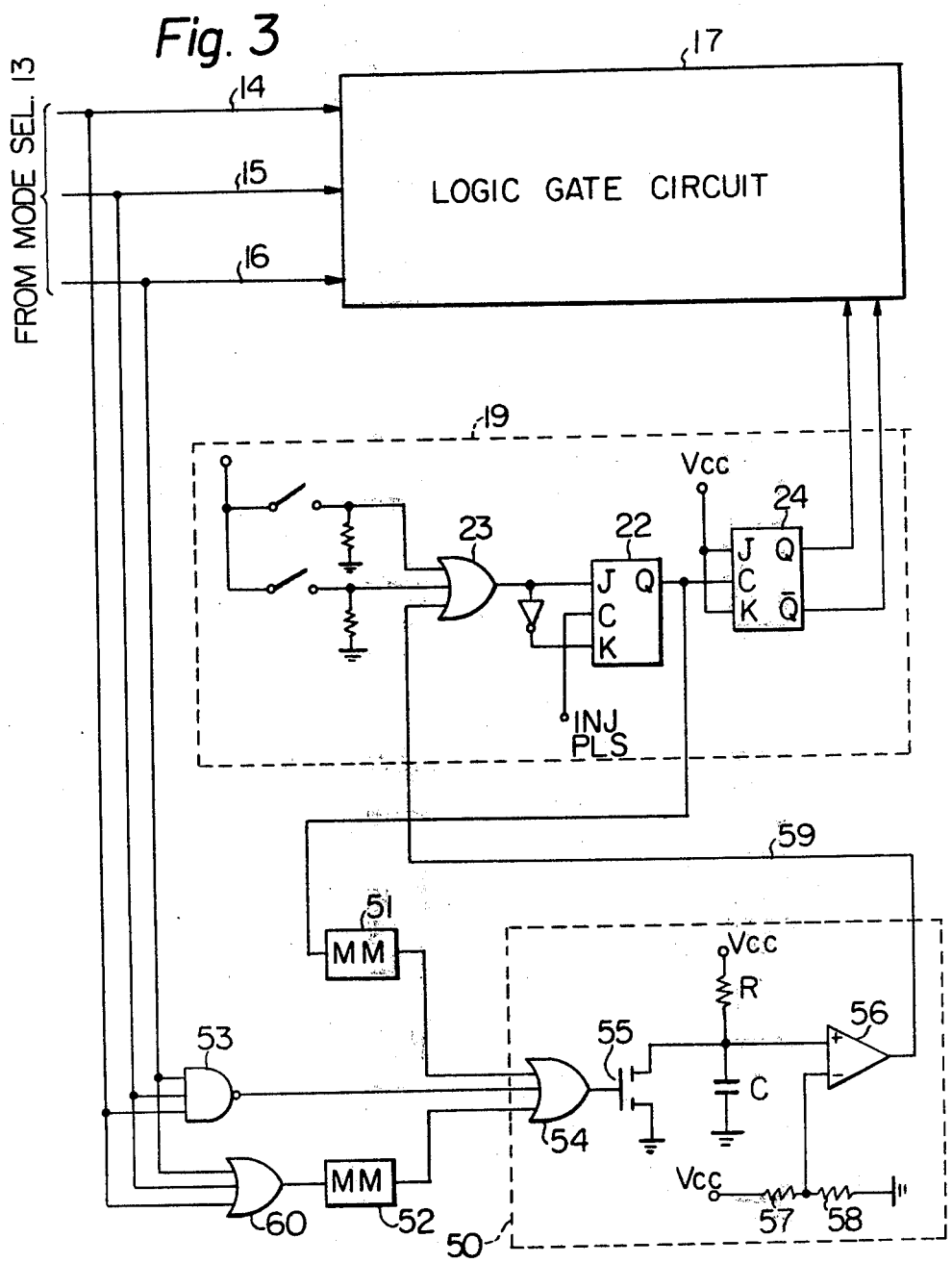
FIG. 3 is a circuit block diagram of a second preferred embodiment of the invention.

In highway vehicle operations a cruising operation may exist for such a long period of time that there is no signal that triggers the switching circuit 19 so that only one group of cylinders remains deactivated over an inadequately extended period of time. As shown in FIG. 3 a modification of the previous embodiment includes a timing circuit 50 which receives its inputs through monostable multivibrators 51 and 52 and a NAND gate 53. The monostable 51 provides an output in response to the output from flip-flop 22 of switching circuit 19 as it changes from "0" to "1" and delivers it through OR gate 54 to the control gate of a switching device or transistor 55, with its first controlled electrode being connected to ground and its second controlled electrode connected to the voltage supply source Vcc through resistor R. A capacitor C is connected across the first and second controlled electrodes of the transistor 55. The junction of the resistor R and capacitor C is connected to the noninverting input of an operational amplifier comparator 56 to provide comparison between the voltage across capacitor C and a reference supplied to its inverting input from the junction of resistors 57 and 58 connected between voltage supply source Vcc and ground. The output of the comparator 56 is connected by means of lead 59 to the J input of flip-flop 22 via OR gate 23. When a signal is applied to the control gate of transistor 55, it commences to conduct and instantly discharges capacitor C. The capacitor C then begins to charge through resistor R so that the voltage thereacross increases at a rate determined by time constant RC. When the charge on capacitor C reaches the reference value the comparator 56 is driven to a high voltage state so that flip-flop 22 is triggered to the "1" logic state. Thus, the output from monostable 51 serves as a reset pulse for providing subsequent timing action.

Another input to the timing circuit 50 is applied through the monostable 52 whose input is connected to the output leads 14, 15 and 16 of the mode selector 13 via OR gate 60. The monostable 52 produces an output in response the change in voltage level from "1" to "0" so that timing circuit 50 will be reset at the leading edge of the signal on each of leads 14 to 16. The NAND gate 53 has its inputs connected to the leads 14 to 16 to provide an output indicative of the state that the engine demands high output power.

Figure 4:
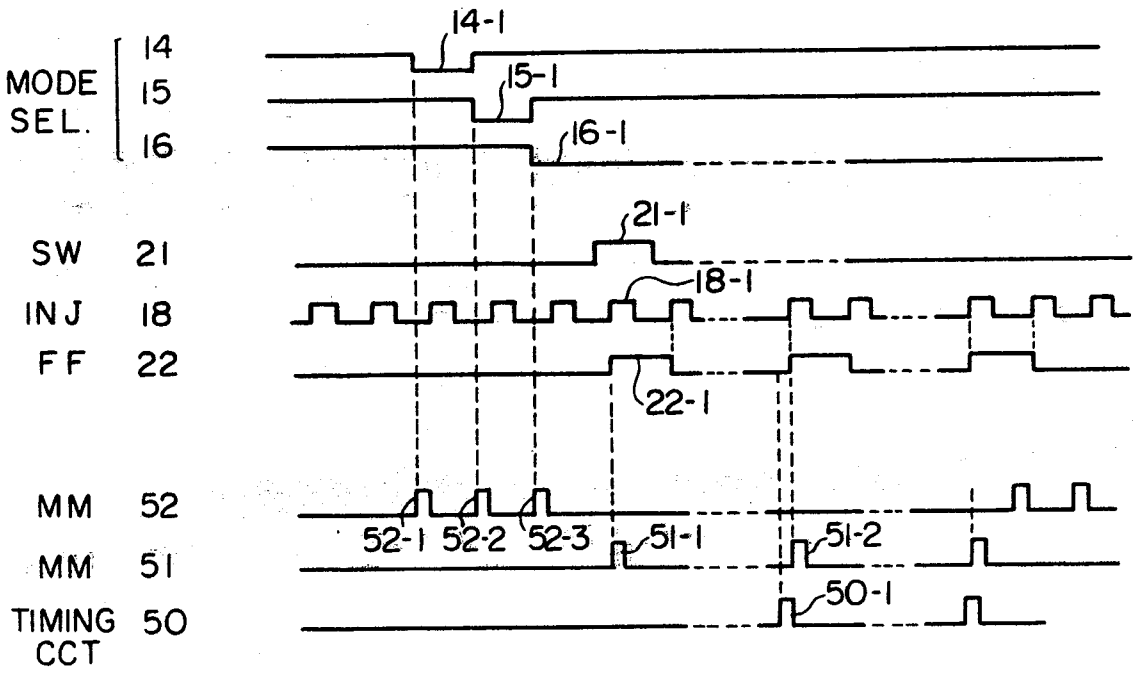
FIG. 4 is a timing diagram useful for describing the operation of FIG. 3.

The operation of the embodiment of FIG. 3 is will be understood by reference to FIG. 4 in which deactivation pulses 14-1, 15-1 and 16-1 are shown to occur at intervals smaller than the interval set by the timing circuit 50 so that pulses 52-1, 52-2 and 52-3 produced in response to the signals on leads 14 to 16 have no effect on the timing circuit.

A throttle signal 21-1 from sensor 21 will cause flip-flop 22 to produce an output 22-1 in response to an injection pulse 18-1. A pulse 51-1 is produced in response to the pulse 22-1 to reset the timing circuit. On a cruising drive there will substantially be no throttling operations over an extended period of time so that the timing circuit produces an output 50-1 after the elapse of a predetermined interval from the application of the reset pulse 51-1. The output 50-1 is applied to flip-flop 22 which results in a change in the binary output states of the switching circuit 19 and accordingly the deactivated injector groups are switched from one to the other. Since the cruising condition demands minimum engine output power so that the number of working cylinders is reduced to a minimum, the switching action during such light load operations will produce no harmful results on the engine performance as previously described. The turn-on of flip-flop 22 by the signal 50-1 will cause the monostable 51 to generate an output 51-2 which in turn resets the timing circuit 50 to start the next timing operation. Therefore, it is understood that the timing circuit 50 automatically generates a train of switching command pulses at predetermined intervals as long as the light load condition exists. While the monostable multivibrator 51 is connected to the output of flip-flop 22 it is to be understood that the monostable 51 could equally as well be connected to the output of flip-flop 24, i.e., the output of switching circuit 19.

Since the appearance of "0" of leads 14 to 16 indicates that the engine is at full load, the timing circuit 50 remains in the reset condition by the output from NAND gate 53 during such condition. This avoids switching action whenever high-power demand takes place suddenly while the next timing operation proceeds. The resetting operation by the output from monostable 52 is also effective in avoiding the switching action while the deactivated cylinders are in the process of increase or decrease in number.

What is claimed is:

1. An internal combustion engine having a throttle valve and a first and a second group of cylinders adapted to be activated and deactivated in response to varying loads of the engine, comprising:

means responsive to said varying engine loads to determine the number of deactivated cylinders such that at maximum load the number of deactivated cylinders is zero and at minimum load the number of deactivated cylinders is at a maximum;

first means for detecting when said throttle valve is nearly wide open;

second means for detecting when said throttle valve is nearly closed;

means for switching between said first and second groups of cylinders in response to said first and second means; and means for selectively deactivating the cylinders of the determined number in said switched group.

2. An internal combustion engine as claimed in claim 1, wherein said maximum number equals to one-half of the total number of said cylinders.

3. An internal combustion engine as claimed in claim 1, further comprising resettable timing means for generating a timing signal after the elapse of a predetermined period of time from the application of an input signal thereto, said timing means having its input connected to respond to the switching of said switching means and its output connected to the input of said switching means.

4. An internal combustion engine as claimed in claim 3, further comprising means for detecting when said engine is at maximum load for resetting said timing means.

5. An internal combustion engine as claimed in claim 3, further comprising means for resetting said timing means in response to a change in said varying loads.

6. An electronic fuel injection system including a source of injection signals for use in an internal combustion engine having a throttle valve and a first and a second group of cylinders each being provided with a fuel injector adapted to be applied with said injection signal in response to varying loads of said engine, comprising:

means responsive to said varying engine loads to determine the number of deactivated cylinders such that at maximum load the number of deactivated cylinders is zero and at minimum load the number of deactivated cylinders is one half of the total number of said cylinders;

first means for detecting when said throttle valve is nearly wide open;

second means for detecting when said throttle valve is nearly closed;

means for switching between said first and second groups of cylinders in response to said first and second means; and logic gate means selectively inhibiting the application of said signals to injectors associated with the cylinders of the selected group, said inhibited injectors being equal in number to said determined number of deactivated cylinders.

7. An electronic fuel injection system as claimed in claim 6, wherein said switching means comprises a bistable device for assuming one of binary states in response to said first and second means, further comprising a monostable device responsive to an output from said bistable device and a resettable timing circuit for providing a timing action in response to the output from said monostable device to generate an output after the elapse of a predetermined period of time from the occurrence of said output from the monostable device, the output of said timing circuit being connected to the input of said bistable device to cause it to change its binary state, the output of said bistable device being connected to said logic gate means to effect a shift in passages of said signals, to said injectors between said first and second groups.

8. An electronic fuel injection system as claimed in claim 7, wherein said bistable device is arranged to change its binary states in response to said injection signal in the presence of the output from said first and second means.

9. An electronic fuel injection system as claimed in claim 6, wherein said number determining means comprises means for detecting high and low levels of intake vacuum to provide a corresponding signal and means for generating an output representing the number of deactivated cylinders, further comprising means for resetting said timing circuit in the presence of said output representing that the number of deactivated cylinders is zero.

10. An electronic fuel injection system as claimed in claim 9, further comprising a monostable device for resetting said timing circuit in response to said number representing output.

* * * * *